US008145498B2

(12) United States Patent
Herre et al.

(10) Patent No.: US 8,145,498 B2
(45) Date of Patent: Mar. 27, 2012

(54) DEVICE AND METHOD FOR GENERATING A CODED MULTI-CHANNEL SIGNAL AND DEVICE AND METHOD FOR DECODING A CODED MULTI-CHANNEL SIGNAL

(75) Inventors: Juergen Herre, Buckenhof (DE); Ralph Sperschneider, Erlangen (DE); Johannes Hilpert, Nuremberg (DE); Karsten Linzmeier, Erlangen (DE); Harald Popp, Tuchenbach (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 601 days.

(21) Appl. No.: 11/681,658

(22) Filed: Mar. 2, 2007

(65) Prior Publication Data

US 2007/0219808 A1 Sep. 20, 2007

Related U.S. Application Data

(63) Continuation of application No. PCT/EP2005/009293, filed on Aug. 29, 2005.

(30) Foreign Application Priority Data

Sep. 3, 2004 (DE) ..... 10 2004 042 819

(51) Int. Cl.
*G10L 19/00* (2006.01)

(52) U.S. Cl. ..... 704/500; 704/501; 704/503; 704/504

(58) Field of Classification Search ..... 704/500, 704/501, 503, 504
See application file for complete search history.

(56) References Cited

U.S. PATENT DOCUMENTS

| | | | | |
|---|---|---|---|---|
| 5,706,309 | A | 1/1998 | Eberlein et al. | |
| 6,529,604 | B1 | 3/2003 | Park et al. | |
| 6,903,669 | B1 * | 6/2005 | Subramaniam | 341/106 |
| 7,392,195 | B2 * | 6/2008 | Fejzo | 704/500 |
| 2002/0019956 | A1 * | 2/2002 | Carter et al. | 714/4 |
| 2002/0067834 | A1 | 6/2002 | Shirayanagi | |

(Continued)

FOREIGN PATENT DOCUMENTS

EP 1376538 A1 1/2004

(Continued)

OTHER PUBLICATIONS

Faller, C. et al. "Binaural Cue Coding Applied to Stereo and Multi-Channel Audio Compression." Presented at 112th Convention of Audio Engineering Society, May 2002, 9 pages, Munich, Germany.

(Continued)

*Primary Examiner* — Qi Han
(74) *Attorney, Agent, or Firm* — Michael A. Glenn; Glenn Patent Group

(57) ABSTRACT

In a multi-channel encoder generating several different parameter sets for reconstructing a multi-channel output signal using at least one transmission channel, the data stream is written such that the two parameter sets are decodable independently of each other. Thus, a multi-channel decoder is enabled to skip a parameter set which is marked as optional and/or has a higher version number when reading the data stream and still to perform a valid multi-channel reconstruction using a data set marked as mandatory or a data set having a sufficiently low version number. This achieves a flexible encoder/decoder concept suitable for future updates characterized by backward compatibility and reliability.

23 Claims, 9 Drawing Sheets numBccDataMand: number of mandatory parameter sets
optBccDataPresent: Are there optional parameter sets?
numBccDataOpt: number of optional parameter sets
BccDataIDi: type and version number of a parameter set I
LengthInfo optional i: length in bits of the i-th parameter set

U.S. PATENT DOCUMENTS

| | | | | |
|---|---|---|---|---|
| 2002/0083433 | A1* | 6/2002 | Yamanaka | 725/1 |
| 2003/0026441 | A1 | 2/2003 | Faller | |
| 2003/0033569 | A1* | 2/2003 | Klein Middelink et al. | 714/751 |
| 2003/0035553 | A1 | 2/2003 | Baumgarte | |
| 2003/0219130 | A1 | 11/2003 | Baumgarte | |
| 2004/0160962 | A1* | 8/2004 | Johnston et al. | 370/395.5 |
| 2005/0180579 | A1* | 8/2005 | Baumgarte et al. | 381/63 |

FOREIGN PATENT DOCUMENTS

| | | | |
|---|---|---|---|
| EP | 1881486 | B1 | 3/2009 |
| RU | 2129336 | C1 | 4/1999 |
| RU | 2197776 | C2 | 1/2003 |
| WO | WO 03/090207 | A1 | 10/2003 |
| WO | WO 2004/072956 | A1 | 8/2004 |

OTHER PUBLICATIONS

Faller, C. et al. "Binaural Cue Coding—Part II: Schemes and Applications." IEEE Transactions on Speech and Audio Processing, vol. 11, No. 6, Nov. 2003.

Grill, B. et al. "Improved MPEG-2 Audio Multi-Channel Encoding." AES-Preprint 3865, Presented at 96$^{th}$ Convention of Audio Engineering Society, Feb. 1994, Amsterdam.

Herre, J. et al. "Intensity Stereo Coding." AES-Preprint 3799, Presented at 96$^{th}$ Convention of Audio Engineering Society, Feb. 1994, Amsterdam.

Herre, J. et al. "MP3 Surround: Efficient and Compatible Coding of Multi-Channel Audio." Audio Engineering Society 116th Convention, May 2004, 14 pages, Berlin.

ISO/IEC JTC1/SC29/WG11. "Coding of Moving Pictures and Audio." Text of ISO/IEC 14496-3:2001/PDAM 1. International Organisation for Standardisation, May 2002, pp. 6-18.

Kovesi, B. et al. "A Scalable Speech and Audio Coding Scheme with Continuous Bitrate Flexibility." IEEE International Conference on Acoustics, Speech, and Signal Processing, vol. 1, pp. 273-276, May 2004, France.

Schuijers, E. et al. "Advances in Parametric Coding for High-Quality Audio." IEEE Benelux Workshop on Model Based Processing and Coding of Audio, Nov. 2002, pp. 73-79, Belguim.

Schuijers, E., et al. "Low Complexity Parametric Stereo Coding." Presented at 116$^{th}$ Convention of Audio Engineering Society, May 2004, 11 pages, Berlin, Germany.

Theile, G. et al. MUSICAM-Surround: A Universal Multi-Channel Coding System Compatible with ISO 11172-3, AES Preprint, Oct. 1992, San Francisco.

* cited by examiner numBccDataMand: number of mandatory parameter sets
optBccDataPresent: Are there optional parameter sets?
numBccDataOpt: number of optional parameter sets
BccDataIDi: type and version number of a parameter set I
LengthInfo optional i: length in bits of the i-th parameter set Presence and Number of Optional Parameter Sets

```
numBccData = numBccDataMand;
if (optBccDataPresent) {                    1  uimsbf
        numBccData += numBccDataOptM1       3  uimsbf
+ 1:
                OptChunkInfo();
}
```

FIGURE 3A

Parameter Set Identifier

| BccDataID | Symbolic name |
|---|---|
| 0 | (reserved) |
| 1 | ICLD_V1 |
| 2 | ICTD_V1 |
| 3 | ICC_V1 |
| 4 | ICLD_V2 |
| >=5 | Undefined (reserved) |

V1, V2: syntax version info

ICLD: inter-channel level differences
ICTD: inter-channel time differences
ICC: inter-channel coherence information

FIGURE 3B

Identification of Optional Parameter Sets

```
        OptChunkInfo()
{
        for (bccData = numBccDataMand; bccData<
numBccData;
                bccData++){
        bccDataOptional[bccData] = 1;
        bccDataID[bccData];                          6  uimsbf
        GetOptChunkLen();
        }
}
```

FIGURE 3C

Length Information for Optional Parameter Sets

```
        OptChunkLen()
{
        if (bccData != numBccData -1) {
                if (bccDataLenBitsPresent[bccData]) {     1
                        bccDataLenBits[bccData] =         4  uimsbf
        bccDataLenBitsM1[bccData] + 1;
                }
        }
        else {
                bccDataLenBitsPresent[bccData] = 0;
        }
}
```

FIGURE 3D

Parameter Set Reading Loop

```
for (bccData = 0; bccData < numBccData;
bccData++) {
        ChunkLen();
        BccData();
}
```

FIGURE 4A

Length Information Reading

```
ChunkLen()
{
if (
bccDataLenBitsPresent[bccData] ) {
        bccDataLen[bccData]    bccDataLenBits    uimsbf
}
}
```

FIGURE 4B

Parameter Set Switch

```
BccData()
{
        switch ( bccDataID[BccData]){

        case ICLD_V1: IcldV1Data(numBccBlocks); break;
        case ICTD_V1: IctdV1Data(); break;
        case ICC_V1: IccV1Data(); break;
        case ICLD_V2: IcldV2Data(); break;
        default:
                if (bccDataOptional[BccData]){
                        if (bccDataLenBitsPresent[bccData]) /* skip
and continue */;
                        else /* stop parsing, start output */
                else /* exit */;
        }
}
```

FIGURE 4C

DEVICE AND METHOD FOR GENERATING A CODED MULTI-CHANNEL SIGNAL AND DEVICE AND METHOD FOR DECODING A CODED MULTI-CHANNEL SIGNAL

CROSS-REFERENCE TO RELATED APPLICATION

This application is a continuation of copending International Application No. PCT/EP2005/009293, filed on Aug. 29, 2005, which designated the United States and was not published in English.

BACKGROUND OF THE INVENTION

1. Field of the Invention

The present invention relates to parametric audio multi-channel processing techniques and, in particular, to an efficient arrangement of parametric side information, when there are several different parameter sets available for reconstruction.

2. Description of the Related Art

In addition to the two stereo channels, a recommended multi-channel surround representation includes a center channel C and two surround channels, i.e. the left surround channel Ls and the right surround channel Rs, and additionally, if applicable, a subwoofer channel also referred to as LFE channel (LFE=Low Frequency Enhancement). This reference sound format is also referred to as 3/2 (plus LFE) stereo and recently also as 5.1 multi-channel, which means that there are three front channels, two surround channels and one LFE channel. In general, five or six transmission channels are required for this recommended multi-channel surround representation. In a reproduction environment, at least five loudspeakers are required in the respective five different positions to obtain an optimal so-called sweet spot a determined distance from the five correctly placed loudspeakers. However, with respect to its positioning, the subwoofer is usable in a relatively free way.

There are several techniques for reducing the amount of data required to transmit a multi-channel audio signal. Such techniques are also called joint stereo techniques. For this purpose, reference is made to FIG. 5. FIG. 5 shows a joint stereo device 60. This device may be a device implementing, for example, the intensity stereo technique (IS technique) or the binaural cue coding (BCC). Such a device generally receives at least two channels (CH1, CH2, . . . CHn) as input signal and outputs at least one single carrier channel (downmix) and parametric data, i.e. one or more parameter sets. The parametric data are defined so that an approximation of each original channel (CH1, CH2, . . . CHn) may be calculated in a decoder.

Normally, the carrier channel will include subband samples, spectral coefficients or time domain samples, etc., which provide a comparatively fine representation of the underlying signal, while the parametric data and/or parameter sets do not include any such samples or spectral coefficients. Instead, the parametric data include control parameters for controlling a determined reconstruction algorithm, such as weighting by multiplication, time shifting, frequency shifting, . . . . The parametric data thus include only a comparatively rough representation of the signal or the associated channel. Expressed in numbers, the amount of data required by a carrier channel is in the range of 60 to 70 kbit/s, while the amount of data required by parametric side information is in the order from 1.5 kbit/s for a channel. One example for parametric data are the known scale factors, intensity stereo information or binaural cue parameters, as will be described below.

The intensity stereo coding technique is described in the AES preprint 3799 entitled "Intensity stereo coding" J. Herre, K. H. Brandenburg, D. Lederer, February 1994, Amsterdam. In general, the concept of intensity stereo is based on a main axis transform which is to be applied to data of the two stereophonic audio channels. If most data points are placed around the first main axis, a coding gain may be achieved by rotating both signals by a determined angle prior to the coding. However, this does not always apply to real stereophonic reproduction techniques. The reconstructed signals for the left and right channels consist of differently weighted or scaled versions of the same transmitted signal. Nevertheless, the reconstructed signals differ in amplitude, but they are identical with respect to their phase information. The energy time envelopes of both original audio channels, however, are maintained by means of the selective scaling operation typically operating in frequency-selective fashion. This corresponds to the human sound perception at high frequencies where the dominant spatial cues are determined by the energy envelopes.

In addition, in practical implementations the transmitted signal, i.e. the carrier channel, is formed of the sum signal of the left channel and the right channel instead of rotating both components. Furthermore, this processing, i.e. the generation of the intensity stereo parameters for performing the scaling operation, is performed in a frequency-selective way, i.e. independently of each other for each scale factor band, i.e. for each encoder frequency partition. Preferably, both channels are combined to form a combined or "carrier" channel. In addition to the combined channel, the intensity stereo information is determined which depends on the energy of the first channel, the energy of the second channel and the energy of the combined or sum channel.

The BCC technique is described in the AES convention paper 5574 entitled "Binaural cue coding applied to stereo and multi-channel audio compression", C. Faller, F. Baumgarte, May 2002, München. In BCC coding, a number of audio input channels is converted to a spectral representation using a DFT-based transform with overlapping windows. The resulting spectrum is divided into non-overlapping partitions. Each partition has a bandwidth proportional to an equivalent right-angled bandwidth (ERB). So-called inter-channel level differences (ICLD) as well as so-called inter-channel time differences (ICTD) are calculated for each partition, i.e. for each band and for each frame k, i.e. a block of time samples. The ICLD and ICDT parameters are quantized and coded to obtain a BCC bit stream. The inter-channel level differences and the inter-channel time differences are given for each channel with respect to a reference channel. In particular, the parameters are calculated according to predetermined formulae depending on the particular divisions of the signal to be processed.

On the decoder side, the decoder receives a mono signal and the BCC bit stream, i.e. a first parameter set for the inter-channel time differences and a second parameter set for the inter-channel level differences. The mono signal is transformed to the frequency domain and input into a synthesis block also receiving decoded ICLD and ICTD values. In the synthesis block or reconstruction block, the BCC parameters (ICLD and ICTD) are used to perform a weighting operation of the mono signal to reconstruct the multi-channel signal, which then, after a frequency/time conversion, represents a reconstruction of the original multi-channel audio signal.

In the case of BCC, the joint stereo module 60 operates to output the channel side information so that the parametric channel data are quantized and coded ICLD and ICTD parameters, wherein one of the original channels may be used as reference channel for coding the channel side information. Normally, the carrier channel is formed of the sum of the participating original channels.

Of course, the above technique only provides a mono representation for a decoder which is only able to decode the carrier channel, but which is not capable of generating the parameter data for generating one or more approximations of more than one input channel.

The audio coding technique referred to as BCC technique is further described in the US patent applications U.S. 2003/0219130 A1, 2003/0026441 A1 and 2003/0035553 A1. In addition, further see "Binaural Cue Coding. Part. II: Schemes and Applications", C. Faller and F. Baumgarte, IEEE: Transactions on Audio and Speech Proc., Vol. 11, No. 6, November 1993. Further, also see C. Faller and F. Baumgarte "Binaural Cue Coding applied to Stereo and Multi-Channel Audio compression", Preprint, 112$^{th}$ Convention of the Audio Engineering Society (AES), May 2002, and J. Herre, C. Faller, C. Ertel, J. Hilpert, A. Hoelzer, C. Spenger "MP3 Surround: Efficient and Compatible Coding of Multi-Channel Audio", 116$^{th}$ AES Convention, Berlin, 2004, Preprint 6049. In the following, there will be represented a typical general BCC scheme for multi-channel audio coding in more detail with respect to FIGS. 6 to 8. FIG. 6 shows a general BCC coding scheme for coding/transmission of multi-channel audio signals. The multi-channel audio input signal is input at an input 110 of a BCC encoder 112 and is "mixed down" in a so-called downmix block 114, i.e. converted to a single sum channel. In the present example, the signal at the input 110 is a 5-channel surround signal having a front left channel and a front right channel, a left surround channel and a right surround channel, and a center channel. Typically, the downmix block generates a sum signal by simple addition of these five channels into a mono signal. Other downmix schemes are known in the art, all resulting in generating, using a multi-channel input signal, a downmix signal having a single channel or having a number of downmix channels which, in any case, is less than the number of original input channels. In the present example, a downmix operation would already be achieved if four carrier channels were generated from the five input channels. The single output channel and/or the number of output channels is output on a sum signal line 115.

Side information obtained by a BCC analysis block 116 are output on a side information line 117. In the BCC analysis block, parameter sets for ICLD, ICTD or inter-channel correlation values (ICC values) may be calculated. Thus, there are up to three different parameter sets (ICLD, ICTD and ICC) for the reconstruction in the BCC synthesis block 122.

The sum signal and the side information with the parameter sets are typically transmitted to a BCC decoder 120 in a quantized and coded format. The BCC decoder splits the transmitted sum signal into a number of subbands and performs scalings, delays and further processing to generate the subbands of the several channels to be reconstructed. This processing is performed so that the ICLD, ICTD and ICC parameters (cues) of a reconstructed multi-channel signal at output 121 are similar to the respective cues for the original multi-channel signal at input 110 into the BCC encoder 112. For this purpose, the BCC decoder 120 includes a BCC synthesis block 122 and a side information processing block 123.

The following will illustrate the internal structure of the BCC synthesis block 122 with respect to FIG. 7. The sum signal on the line 115 is input into a time/frequency conversion block typically embodied as filter bank FB 125. At the output of block 125, there is a number N of subband signals or, in an extreme case, a block of spectral coefficients, if the audio filter bank 125 performs a transform generating N spectral coefficients from N time domain samples.

The BCC synthesis block 122 further includes a delay stage 126, a level modification stage 127, a correlation processing stage 128 and a stage IFB 129 representing an inverse filter bank. At the output of the stage 129, the reconstructed multi-channel audio signal having, for example, five channels in the case of a 5-channel surround system may be output on a set of loudspeakers 124, as illustrated in FIG. 6.

FIG. 7 further illustrates that the input signal s(n) is converted to the frequency domain or filter bank domain by means of element 125. The signal output by element 125 is multiplied so that several versions of the same signal are obtained, as indicated by node 130. The number of versions of the original signal is equal to the number of output channels in the output signal to be reconstructed. If each version of the original signal is subjected to a determined delay. $d_1, d_2, \ldots d_i, d_N$ at the node 130, the result is the situation at the output of blocks 126, which includes the versions of the same signal, but with different delays. The delay parameters are calculated by the side information processing block 123 in FIG. 6 and derived from the inter-channel time differences as they were determined by the BCC analysis block 116.

The same applies to the multiplication parameters $a_1, a_2 \ldots a_i, a_N$, which are also calculated by the side information processing block 123 based on the inter-channel level differences determined by the BCC analysis block 116.

The ICC parameters are calculated by the BCC analysis block 116 and used for controlling the functionality of the block 128 so that determined correlation values between the delayed and level-manipulated signals are obtained at the output of block 128. It is to be noted that the order of the stages 126, 127, 128 may be different from that represented in FIG. 7.

It is further to be noted that, in a blockwise processing of the audio signal, the BCC analysis is also performed blockwise. Furthermore, the BCC analysis is also performed frequency-wise, i.e. in a frequency-selective way. This means that, for each spectral band, there is an ICLD parameter, an ICTD parameter and an ICC parameter. The ICTD parameters for at least one channel across all bands thus represent the ICTD parameter set. The same applies to the ICLD parameter set representing all ICLD parameters for all frequency bands for the reconstruction of at least one output channel. The same applies, in turn, to the ICC parameter set which again includes several individual ICC parameters for various bands for the reconstruction of at least one output channel on the basis of the input channel or sum channel.

In the following, reference is made to FIG. 8 showing a situation from which the determination of BCC parameters may be seen. Normally, the ICLD, ICTD and ICC parameters may be defined between channel pairs. Typically, however, a determination of the ICLD and the ICTD parameters is performed between a reference channel and each other input channel, so that there is a distinct parameter set for each of the input channels. This is also illustrated in FIG. 8B.

However, the ICC parameters may be defined differently. In general, ICC parameters may be generated in the encoder between any channel pairs, as also illustrated schematically in FIG. 8B. In this case, a decoder would perform an ICC synthesis so that approximately the same result is obtained as it was present in the original signal between any channel pairs. However, there has been the suggestion to calculate only ICC parameters between the two strongest channels at any time, i.e. for each time frame. This scheme is represented in FIG. 8C, which shows an example in which, at one time, an ICC parameter between the channels 1 and 2 is calculated and transmitted, and in which, at another time, an ICC parameter between the channels 1 and 5 is calculated. The decoder then synthesizes the inter-channel correlation between the two strongest channels in the decoder and executes further typically heuristic rules for synthesizing the inter-channel coherence for the remaining channel pairs.

With respect to the calculation of, for example, the multiplication parameters $a_1, \ldots a_N$ based on the transmitted ICLD parameters, reference is made to the cited AES convention paper 5574. The ICLD parameters represent an energy distribution in an original multi-channel signal. Without loss of generality, FIG. 8A shows that there are four ICLD parameters representing the energy difference between all other channels and the front left channel. In the side information processing block 123, the multiplication parameters $a_1, \ldots a_N$ are derived from the ICLD parameters so that the total energy of all reconstructed output channels is the same energy as present for the transmitted sum signal or is at least proportional to this energy. One way to determine these parameters is a two-stage process in which, in a first stage, the multiplication factor for the left front channel is set to 1, while multiplication factors for the other channels in FIG. 8C are set to the transmitted ICLD values. Then, in a second stage, the energy of all five channels is calculated and compared to the energy of the transmitted sum signal. Then, all channels are downscaled, namely using a scaling factor which is equal for all channels, wherein the scaling factor is selected so that the total energy of all reconstructed output channels after the scaling is equal to the total energy of the transmitted sum signal and/or the transmitted sum signals.

With respect to the inter-channel coherence measure ICC transmitted from the BCC encoder to the BCC decoder as further parameter set, it is to be noted that a coherence manipulation could be performed by modification of the multiplication factors, such as by multiplying the weighting factors of all subbands by random numbers having values between 20 log $10^{-6}$ and 20 log $10^{-6}$. The pseudo random sequence is typically selected so that the variance for all critical bands is approximately equal and that the average value within each critical band is zero. The same sequence is used for the spectral coefficients of each different frame or block. Thus, the width of the audio scene is controlled by modifications of the variances of the pseudo random sequence. A larger variance generates a larger hearing width. The variance modification may be performed in individual bands having a width of a critical band. This allows the simultaneous existence of several objects in a hearing scene, wherein each object has a different hearing width. A suitable amplitude distribution for the pseudo random sequence is a uniform distribution on a logarithmic scale, such as represented in the US patent publication 2002/0219130 A1.

In order to transmit the five channels in a compatible way, for example in a bit stream format which is also suitable for a normal stereo decoder, there may be used the so-called matrixing technique described in "MUSICAM Surround: A universal multi-channel coding system compatible with ISO/IEC 11172-3", G. Theile and G. Stoll, AES Preprint, October 1992, San Francisco.

Furthermore, see further multi-channel coding techniques described in the publication "Improved MPEG 2 Audio multi-channel encoding", B. Grill, J. Herre, K. H. Brandenburg, I. Eberlein, J. Koller, J. Miller, AES Preprint 3865, February 1994, Amsterdam, wherein a compatibility matrix is used to obtain the downmix channels from the original input channels.

In summary, you can say that the BCC technique allows an efficient and also backward-compatible coding of multi-channel audio material, as also described, for example, in the specialist publication by E. Schuijer, J. Breebaart, H. Purnhagen, J. Engdegård entitled "Low-Complexity Parametric Stereo Coding", 119$^{th}$ AES Convention, Berlin, 2004, Preprint 6073. In this context, mention should also be made of the MPEG-4 standard and particularly the expansion to parametric audio techniques, wherein this standard part is also known by the designation ISO/IEC 14496-3: 2001/FDAM 2 (Parametric Audio). In this respect, there should be mentioned, in particular, the syntax in table 8.9 of the MPEG-4 standard entitled "syntax of the $ps_{13}$ data( )". In this example, we should mention the syntax elements "enable_icc" and "enable_ipdopd", wherein these syntax elements are used to turn on and off a transmission of an ICC parameter and a phase corresponding to inter-channel time differences. There should further be mentioned the syntax elements "icc_data( )" "ipd_data( )" and "opd_data( )".

In summary, it is to be noted that generally such parametric multi-channel techniques are used employing one or several transmitted carrier channels, wherein M transmitted channels are formed from N original channels to reconstruct again the N output channels or a number K of output channels, wherein K is equal to or less than the number of original channels N.

What is problematic in all techniques described until now is the question of how format compatibility may be created between different types of decoders for the multi-channel decoding, for example for BCC decoders and for different versions of parametric side information. In particular, two problems arise when different multi-channel decoders exist on the market, while at the same time side information having different parameter sets generated by different multi-channel decoders is on the market and thus available for the user who only has a single decoder.

First, it is desirable to have decoders with high computing capacity providing the optimal multi-channel sound quality in decoding. At the same time, however, there will also be decoders that are operated under resource-limited conditions, such as decoders in mobile devices, such as mobile phones. Of course, such decoders should provide a multi-channel output having a quality that is still as good as possible, but should also have only a limited computational effort. This results in the question whether there can be bit stream formats with parameter sets for spatial reconstruction that support this kind of scalability, i.e. that allow both decoding with high complexity and thus optimum quality and decoding with reduced complexity, but also with correspondingly reduced quality.

A further aspect to be considered when introducing new generations/versions of BCC encoders and thus of BCC bit streams is the question of how a compatibility between different versions of BCC bit streams and BCC decoders may be maintained. In other words, it is desirable that new BCC parameter sets and also updated old parameter sets are backward compatible. Thus, it is of course desirable to provide an upgrade path for BCC users allowing to introduce new improved multi-channel schemes when they are available due to technical progress. On the other hand, new BCC bit stream formats normally result in incompatibilities between these bit streams and various (older) BCC decoder versions.

In particular, it is to be noted that multi-channel encoders/decoders are to be used in an increasing number of fields of application in which there are not necessarily available the maximum computing capacities, but which do not always necessarily require the full sound quality either.

SUMMARY OF THE INVENTION

It is the object of the present invention to provide a concept that is efficient and flexible, i.e. which allows, for example, the integration of new parameter sets or the updating of old parameter sets and which, at the same time, may be used flexibly in a variety of different applications.

In accordance with a first aspect, the present invention provides a device for generating a coded multi-channel signal representing an uncoded multi-channel signal having N original channels, wherein N is equal to or larger than 2, the device having a unit for providing parameter information for reconstructing K output channels from M transmission channels, wherein M is equal to or larger than 1 and equal to or less than N, wherein K is larger than M and equal to or less than N, wherein the parameter information has at least one first parameter set and a different second parameter set for reconstructing one and the same output channel, wherein the second parameter set has associated syntax version information; and a unit for writing a data stream, wherein the unit for writing is designed to write the first and the second parameter sets into the data stream so that a reconstruction of at least one of the K output channels may be done using the first parameter set, without using the second parameter set and using at least one of the M transmission channels.

In accordance with a second aspect, the present invention provides a device for decoding a coded multi-channel signal representing an uncoded multi-channel signal having N original channels, wherein the coded multi-channel signal is represented by a data stream having parameter information for reconstructing K output channels from M transmission channels, wherein M is equal to or larger than 1 and equal to or less than N, wherein K is larger than M and equal to or less than N, wherein the parameter information has at least two different parameter sets for reconstructing one and the same output channel, and wherein the first and the second parameter sets are written into the data stream so that a reconstruction of the K output channels may be done using the first parameter set and without using the second parameter set, wherein the second parameter set has associated syntax version information, the device having a data stream reader for reading the data stream to read in the first parameter set and to skip the second parameter set when the syntax version information associated with the second parameter set is not compatible with given syntax version information of the device for decoding, and to read in the second parameter set when the syntax version information is compatible with the given syntax version information.

In accordance with a third aspect, the present invention provides a method for generating a coded multi-channel signal representing an uncoded multi-channel signal having N original channels, wherein N is equal to or larger than 2, the method having the steps of providing parameter information for reconstructing K output channels from M transmission channels, wherein M is equal to or larger than 1 and equal to or less than N, wherein K is larger than M and equal to or less than N, wherein the parameter information has at least two different parameter sets for reconstructing one and the same output channel; and writing a data stream by writing the first and the second parameter sets into the data stream so that a reconstruction of at least one of the K output channels may be done using the first parameter set, without using the second parameter set and using at least one of the M transmission channels, wherein the second parameter set has associated syntax version information.

In accordance with a fourth aspect, the present invention provides a method for decoding a coded multi-channel signal representing an uncoded multi-channel signal having N original channels, wherein the coded multi-channel signal is represented by a data stream having parameter information for reconstructing K output channels from M transmission channels, wherein M is equal to or larger than 1 and equal to or less than N, wherein K is larger than M and equal to or less than N, wherein the parameter information has at least two different parameter sets for reconstructing one and the same output channel, and wherein the first and the second parameter sets are written into the data stream so that a reconstruction of the K output channels may be done using the first parameter set and without using the second parameter set, wherein the second parameter set has associated syntax version information, the method having the step of reading the data stream to read in the first parameter set and to skip the second parameter set when the syntax version information associated with the second parameter set is not compatible with given syntax version information of the device for decoding, and to read in the second parameter set when the syntax version information is compatible with the given syntax version information.

In accordance with a fifth aspect, the present invention provides a computer program having a program code for performing the first above-mentioned method, when the computer program runs on a computer.

In accordance with a sixth aspect, the present invention provides a computer program having a program code for performing the second above-mentioned method, when the computer program runs on a computer.

The present invention is based on the finding that an efficient and backward-compatible decoding of coded multi-channel signals is achieved when the coded multi-channel signal is written as data stream which, in addition to the at least one transmission channel or carrier channel, includes at least two different parameter sets, wherein the two parameter sets are written into the data stream so that a reconstruction of the output channels may be performed with less than the at least two parameter sets. According to the invention, the data stream is written so that a decoder may identify which one of the parameter sets is required for the reconstruction and which parameter set is optionally necessary for the reconstruction. In this case, a decoder may only use the parameter set which is indispensable (i.e. obligatory) for the reconstruction, and simply ignore the optional parameter sets, if external circumstances demand this. This has the result that the decoder is fast and manages with limited computing capacity when only using the mandatory parameter set for reconstruction, while, at the same time, another decoder may perform a high-quality multi-channel reconstruction based on the same data stream representing the coded multi-channel signal, which, however, also requires more time and/or more computing capacity and/or, more generally speaking, more decoder resources.

In a preferred embodiment of the present invention, the mandatory parameter set is the one including the inter-channel level differences. As has been found according to the invention, these inter-channel level differences are extremely important to define the basic multi-channel sound distribution between the output channels for all types of reproduction situations. The inter-channel time differences may be classified as optional parameter sets, because they are mainly relevant when there is to be a presentation either via headphones, i.e. two output channels from one transmitted channel, or when a multi-channel audio representation occurs in a so-called relatively "dry" acoustic situation, i.e. an acoustic situation including little echo. The inter-channel time differences may thus already be classified as optional parameter set.

The inter-channel correlation values are important to provide the width of sound sources and to further generate the impression for a listener that he or she is situated in a scenario with complex sound sources, for example a classical orchestra, which includes many uncorrelated sound components. The ICC parameter set may thus also be classified as optional parameter set, because it evidently has a significant influence on quality, but, in reconstruction, often results in a relative large computing effort which, for example, is not so significant in the mandatory parameter set of the inter-channel level differences, because there is essentially only required a weighting operation, i.e. a multiplication that may be executed efficiently with respect to computing.

With respect to the problem of the backward compatibility of coded multi-channel signals with parameter sets in the data streams, the parameter set having, for example, a higher version number is written into the data stream such that a reconstruction by a decoder may be done without this parameter set, with the result that a decoder will use only the first parameter set for the reconstruction and simply skip the second parameter set, when it is establishes that it cannot process this second parameter set.

On the decoder side, this means that the decoder has to read in a parameter set completely and process it, when it has identified this parameter set as mandatory parameter set, that, however, the decoder will simply skip the bits in the bit stream belonging to a parameter set when it encounters a parameter set which is not mandatory for the reconstruction, i.e. which is marked as optional. The decoder thus does not have to have any knowledge on the syntax of the second parameter set to be able to deal with the coded multi-channel signal, but can simply skip it and simply proceed with the subsequent areas of the coded multi-channel signal which it may still need for the reconstruction.

Preferably, length information is thus inserted into the data stream for parameter sets marked as optional, which allows the decoder to simply skip the bits associated with this parameter set in a fast and efficient way and to only take the parameter sets marked as mandatory for decoding. With respect to the backward compatibility, it is further preferred that a version number is associated with at least each optional parameter set, which specifies by which encoder version this parameter set was generated. Thus, for example, the parameter set for the inter-channel level differences of the lowest version would be marked as mandatory in a data stream, while a parameter set for inter-channel level differences of a later encoder version obtains another version number, so that a decoder will simply use the corresponding parameter set with lower version number for the reconstruction when it establishes that it cannot process the parameter set having the higher version number.

Finally, it is to be noted that the data stream representing the multi-channel signal does not necessarily also have to contain the transmission channels. Instead, they may have been generated and transmitted separately, such as in a case in which the BCC parameters are written to a CD into a corresponding channel afterwards, wherein the CD already contains the M (=equal to or larger than 1) transmission channels.

BRIEF DESCRIPTION OF THE DRAWINGS

Preferred embodiments of the present invention will be explained in detail in the following with respect to the accompanying drawings, in which:

FIGS. 3*a* to 3*d* show a preferred implementation for the parameter set configuration according to the present invention;

FIGS. 4*a* to 4*c* show a preferred implementation of the parameter set data according to the present invention;

DESCRIPTION OF THE PREFERRED EMBODIMENTS

Figure 2A:
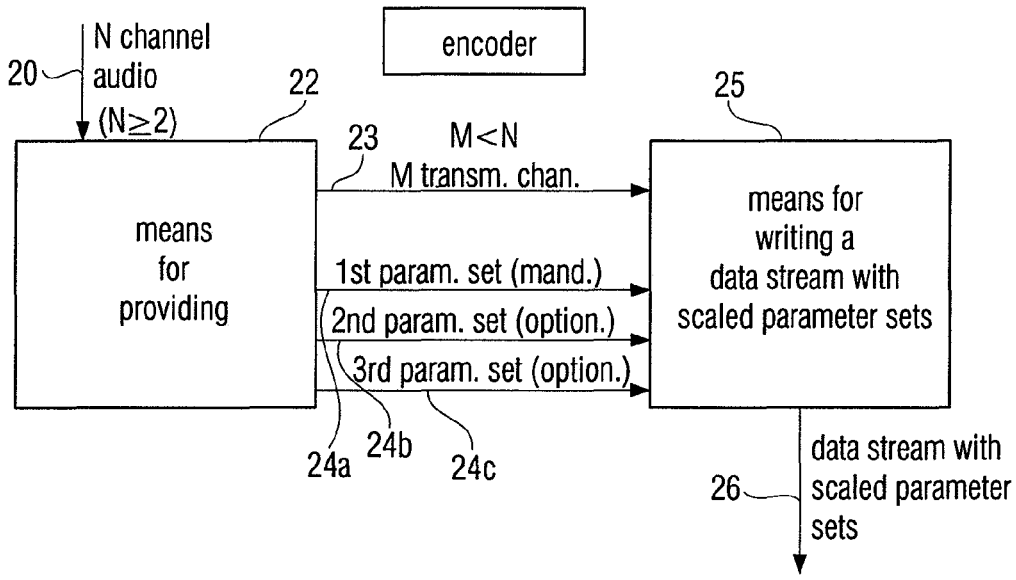
FIG. 2*a* is a block circuit diagram of a encoder according to an embodiment of the present invention.

FIG. 2*a* shows a preferred implementation of a device for generating a coded multi-channel signal representing an uncoded multi-channel signal comprising N original channels which are fed into an input 20 of means 22 for providing both M transmission channels and parameter information with at least two parameter sets. In particular, the number M of transmission channels output at an output 23 of the means 22 is smaller than the number N of original audio channels. The individual parameter sets which together represent the parameter information for reconstructing K output channels are applied to outputs 24*a*, 24*b*, 24*c* of the means 22 for providing. The M transmission channels, wherein M is equal to or larger than 1 and less than N, are supplied to means 25 for writing a data stream on the output side, which is applied to output 26, just like the parameter sets at the outputs 24*a*, 24*b*, 24*c*.

As discussed above, the downmix information (M transmission channels) may also be transmitted/stored separately from the parameter information.

The means 25 for writing the data stream representing the coded multi-channel signal is designed to write the M transmission channels into the data stream and to further write the first, the second and the third parameter sets into the data stream so that a reconstruction of the K output channels may be done without using one of the three parameter sets and preferably even without using at least two of the three parameter sets. In this respect, the parameter sets at the outputs 24*a* to 24*c* of the means 22 for providing are marked so that one parameter set, such as the first parameter set, is absolutely required for reconstruction, while the two further parameter sets, i.e. the second parameter set and the third parameter set, are defined so that they are only optionally required for reconstruction.

The means 25 for writing will then write the first parameter set as mandatory parameter set into the data stream and will write the second parameter set and the third parameter set only as optional parameter sets into the data stream, as discussed in the following.

The data stream at output 26 of FIG. 2*a* is fed into a data stream input 27 of a multi-channel decoder illustrated in FIG.

2*b*. The data of the data stream are supplied to means 28 for reading the data stream, wherein the means 28 for reading the data stream, just like the encoder shown in FIG. 2*a*, again comprises a logic output 29 for the M transmission channels extracted from the data stream and further logic outputs 30*a*, 30*b* for the parameter sets contained in the data stream. In a preferred embodiment of the present invention, in which the first parameter set is marked as mandatory or absolutely required for reconstruction, the means 28 for reading will provide this first parameter set to means 31 for reconstructing via the logic output 30*a*. If the means 28 for reading is, for example, fixedly set to read only the mandatory parameter sets and supply them to means 31 for reconstructing, the means 28 will simply skip the second parameter set in the data stream at input 27, which is symbolically represented by the interrupted logic output 30*b* in FIG. 2*b*.

The control whether only mandatory parameter sets or additionally also optional parameter sets are extracted from the data stream and supplied to means 31 may also be supplied to means 28 via a control input 32, wherein resource availability information and/or control information derived therefrom arrive via the control input 32.

Resource availability information may, for example, consist in that a battery-powered decoder establishes that there is still sufficient battery power available so that the means 28 for reading the data stream is instructed to extract not only the mandatory parameter sets, but also the optional parameter sets and to supply them to the means 31 for reconstructing via corresponding logic outputs, so that, in turn, this means provides K output channels at an output 33, wherein K is equal to or less than the original number N of original input channels at the input 20 of FIG. 2*a*. It is to be noted that preferably the number K is equal to the number N, because a decoder will possibly want to generate all output channels coded in the data stream.

The data stream reading means 28 for reading the data stream also operates to read in at least the first parameter set and to be able to skip at least one parameter set, such as the second parameter set, when the scalability in the data stream is made use of, i.e. when a parameter set in the data stream is not used for reconstruction. The reconstruction means 31 is then operable to reconstruct the K output channels using the M transmission channels and the first parameter set, but not using the second parameter set.

In an embodiment of the present invention, the means 22 for providing is a BCC encoder receiving the N original channels and, on the output side, providing the M transmission channels and the individual parameter sets. Alternatively, the means 22 for providing may also be a so-called bit stream transcoder which, on the input side, receives information already written in a non-scalable format (only parameter sets or parameters sets together with transmission channels), as they are generated by the elements 114 and 116 of FIG.7, for example, and which instructs the means 25 for writing correspondingly to rewrite the bit stream to thus write the parameter sets into the data stream in scalable form. This means that, in order to be able to understand the data stream, a decoder does not have to read in and parse all data of the data stream, but may skip the data associated with an optional parameter set when detecting an optional parameter set.

Thus, there are various possibilities for the actual writing of the data stream with the scalable parameter sets. In one embodiment, the beginning of the data for a parameter set may be laid down according to a fixed data stream raster. In such a case, the transmission of length information associated with an optional parameter set is not mandatory. This fixed raster, however, may result in artificially expanding the amount of data of the data stream by padding bits. Thus, it is preferred to associate length information with each optional parameter set so that, when it has the information, a decoder will skip an optional parameter set, i.e. will simply skip a certain number of bits in the preferably serial data stream based on the length information, to then resume reading in and analyzing at the right place of the data stream, i.e. when data for a new parameter set and/or for new information start.

An alternative possibility of signaling the beginning of a new parameter set consists, for example, in having a synchronization pattern precede the actual data which has a certain bit pattern, i.e. which may be identified without actual analysis of the data merely based on a bit pattern search, to signal to a decoder that the data for a parameter set begin here and end at the subsequent synchronization pattern. In such a case, when a parameter set has been identified as optional parameter set, a decoder would look for a synchronization pattern associated with the beginning of the optional parameter set to then perform a pattern search with the bits following the synchronization pattern without parsing until it encounters the next synchronization pattern. The bits between the two synchronization patterns would then not be used for a reconstruction, but would simply be ignored, while the data at the subsequent synchronization pattern signaling the end of the optional parameter set may be used as prescribed according to the bit stream syntax, if these data do not belong to a further optional parameter set.

In a preferred embodiment of the present invention, the at least two parameter sets required for the reconstruction of several channels are classified with respect to their perceptional significance. The parameter set most significant for the perception, i.e. for the quality of the reconstructed multichannel signal, is marked as mandatory parameter set in the data stream, while the other parameter sets are marked only as optional parameter sets. Further grading into mandatory, optional and, for example, parameter sets required only for a studio reconstruction may also be performed to achieve, for example, three scaling steps instead of only two scaling steps. It is to be noted that it is sufficient to mark either the obligatory or preferably the optional parameter sets, because the type of the respectively unmarked parameter set results automatically from the absence of a marking.

Figure 1A:
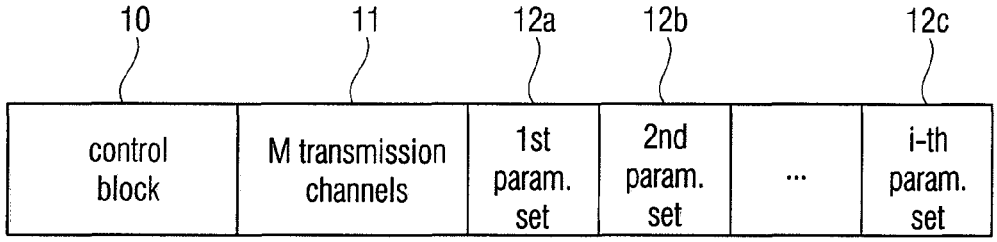
FIG. 1*a* is an overview of a coded multi-channel signal having a determined data stream syntax according to an embodiment of the present invention.
Figure 1B:
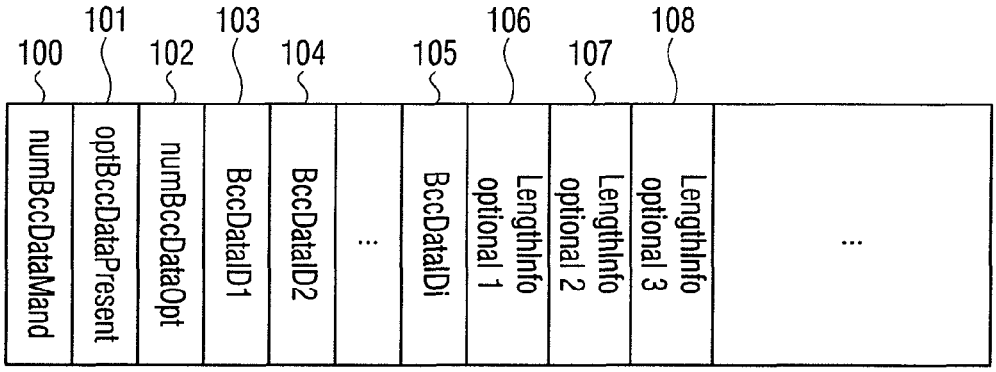
FIG. 1*b* is a detailed representation of the control block of FIG. 1*a* according to an embodiment of the present invention.

FIG. 1*a* shows a schematic representation of the data stream which, in the embodiment shown in FIG. 1*a*, includes first a control block 10, a block in which there are the data of the M transmission channels, which is designated 11, and a block 12*a*, 12*b*, . . . 12*c* for each parameter set. In the preferred embodiment of the present invention, the control block 10 includes various individual pieces of information, as schematically illustrated in FIG. 1*b*. Thus an entry 100 in the control block 10 signals the number of mandatory parameter sets by a field with the title "numBccDataMand". Furthermore, a field 101 signals whether there are optional parameter sets. A field marked "OptBccDataPresent" is used for this purpose. A further field of the control block 10 further signals the number of optional parameter sets with the variable "numBccDataopt". Further blocks 103, 104, 105 signal the type and/or the version number of a parameter set i for each parameter set. The field with the name "BccDataId" is used for this. A further optional sequence of fields 106, 107, 108 gives optional length information designated "Lengthinfo" to each parameter set marked as optional, i.e. which is included in the number of optional parameter sets. This length information gives the length in bits of the corresponding associated, for example $i^{th}$ parameter set. As will be discussed below, "Lengthinfo" may also include information on the number of bits required for signaling the length or alternatively also the actual length specification.

FIGS. 3*a* to 3*d* show a preferred form of the parameter set configuration. The parameter set configuration may be done for each frame, but may also be done, for example, only once for a group of frames, such as at the beginning of a file containing many frames. Thus, FIG. 3*a* gives a definition of the presence and number of optional parameter sets in pseudo code, wherein "uimsbf" stands for "unsigned integer most significant bit first", i.e. for an integer that does not include any sign and whose most significant bit is first in the data stream. Thus, the variable numBccData specifying the number of BCC data is represented first, for example in field 100 of the control block 10.

Furthermore, the field 101 is used to establish whether there are any optional parameter sets at all (optBccDataPresent). Subsequently, the number (numBccDataopt) of optional parameter sets is read in to obtain further information on the optional parameter sets or so-called "chunks" (OptChunkInfo), when this has been done. The variable numBccDataOptM1 contains the suffix "M1" standing for "minus 1". This is balanced again by the addition of "+1" in FIG. 3*d*.

FIG. 3*b* shows an overview of the value that, in an embodiment, the parameter set data identifier may have in the fields 103 to 105. Thus, the variable "BccDataId" may first include the name, i.e. the type of the parameter, i.e. ICLD, ICTD and ICC, and simultaneously a version number V1 or V2, respectively. Thus, it is to be seen in FIG. 3*b* that a data stream actually may contain the inter-channel level differences of a first version V1 and a later second version V2 at the same time, wherein a correspondingly suited decoder for the first version may simply read in ICLD_V1 as mandatory parameter set and can ignore ICLD_V2, while a decoder with higher version number may simply read in ICLD_V2, namely as mandatory parameter set, to ignore, however, ICLD_V1 as parameter set only optionally required in this scenario. Alternatively, the data set may be written so that the obligatory data sets are always only present in one version in the data stream.

FIG. 3*c* shows the identification of optional parameter sets. Thus, in the information on optional parameter sets, the parameter set identifier 103 to 105 of FIG. 1*b* is read in for each parameter set to obtain information on each parameter set that is optional. Furthermore, the length of the parameter set is read in for each optional parameter set, if it was transmitted in the bit stream, as represented by the command "OptChunkLen( )" in FIG. 3*c*.

With respect to the determination of the length information for optional parameter sets, see FIG. 3*d* which illustrates how, in a preferred embodiment of the present invention, the length in bits is read in for each parameter set from the data associated with each optional parameter set.

The parameter set reading loop performed by a decoder is schematically illustrated in FIG. 4*a*. Thus, the actual parameter set data which are in the blocks 12*a* to 12*c* of FIG. 1 are read in with BccData( ).

The reading of the length information is illustrated in FIG. 4*b*. For example, BccDataLenBits describes the number of bits necessary for signaling the actual bit length of a chunk. BccDataLen then actually gives the length in bits that a chunk has. This two-stage system is flexible on the one hand and saves data on the other hand, because it is efficient particularly when the chunks have a heavily varying length in bits, which particularly applies to parameter sets of very different type and thus length. This will allow the future definition of further chunks having nearly any length.

FIG. 4*c* finally represents the parameter set switch, wherein the parameter set identifier, as illustrated in FIG. 3*b*, is evaluated such that parameter sets are associated with the corresponding reconstruction algorithms, so that the case does not occur that, for example, inter-channel level differences are taken for inter-channel time differences, and vice versa.

FIG. 4*c* further shows that, when a parameter set has been identified as optional and decoding using the optional parameter set is not desired, the number of bits of this parameter set is skipped ("skip and continue") to start the output without considering further optional parameter sets when all mandatory parameter sets have been read in (or there are data unknown to the decoder, for example, parameter sets) ("stop parsing, start output"). Such a decoder will thus start the output when it has already read in at least one obligatory chunk and it cannot parse further information in the data stream. Thus, the decoder is not induced to a complete error exit by data stream contents it does not understand. This creates a very robust decoder.

In the following, the functionality of the present invention will be described in more detail based on preferred embodiments of the present invention. For example, parameter information of various types, such as ICLDs, ICTDs, ICCs, and other parameter set information that may be defined in the future are accommodated in different and separate data portions, i.e. in different scaling layers. For this purpose, see again FIGS. 4*a* to 4*c*. The parameter sets are differentiated into mandatory or (obligatory) parameter sets, such as inter-channel level differences parameter sets, and optional parameter sets, such as inter-channel time differences parameter sets and inter-channel correlation value parameter sets.

Information on the number of mandatory parameter sets (numBccDataMand) and the presence (OptBccDataPresent) and the number of optional parameter sets (numBccDataOpt) are provided. Normally, the information on the number of mandatory parameter sets (numBccDataMand) depends on the system specification and thus does not necessarily have to be transmitted explicitly, but may be fixedly laid down between the encoder and the decoder. In contrast, it is preferred to explicitly transmit the number of optional parameter sets (numBccDataopt). When the presence parameter (OptBccDataPresent) indicates the presence of optional parameter sets, as illustrated in FIG. 3*a*, a corresponding evaluation of the information on the optional parameter sets is started.

In the preferred embodiment of the present invention, there is further provided an identifier (BccDataId) for each parameter set. This identifier provides information on the parameter set type, such as ICLD, ICTD or ICC, and/or the syntax version of a certain parameter set, as also illustrated in FIG. 3*b*. Normally, the identifier for mandatory parameter sets is signaled implicitly, while the identifier for optional parameters is signaled explicitly. In this case, however, it has to be laid down between the encoder and the decoder that, for example, the first parameter set encountered is the mandatory parameter set which, in the fixedly laid down scenario, includes, for example, inter-channel level difference parameter sets. Alternatively, the parameter set type information may also be defined implicitly by prescribing the order of parameter set types.

Parameter sets will preferably include parameter set length information. Providing such parameter set length information allows a decoder to ignore this parameter set by simply skipping the associated bits without the decoder even having to know the exact bit stream syntax of the parameter set. For this purpose, see FIG. 4*b*.

In the preferred embodiment of the present invention, mandatory parameter sets thus do not include parameter set length information, because the decoder has to parse and process the data on the mandatory parameter set in any case anyway, instead of being able to simply discard them. Thus, a decoder could be implemented to assume, when it finds a parameter set and the same does not contain any associated further information, that the parameter set (for example ICLD) is among the determined available parameter sets and that, due to the fact that it does not include any corresponding information, this parameter set is a mandatory parameter set.

For optional parameter sets, the parameter set length information may be transmitted or not depending on the case of application. A simple rule may be that, for improving the interoperability between encoder and decoder, all optional parameter sets include parameter set length information. However, to save bits, the length information may not be transmitted for the last parameter set, because there is no more need to skip these data and to access a subsequent parameter set, because the parameter set is the last parameter set anyway. This procedure is evidently useful when a block of data, as illustrated in FIG. 1*a*, is actually terminated by the $i^{th}$ parameter set 12*c* and when subsequently, for example, there are no more control information etc. for the block of the sum signal and/or of the M transmission channels just processed.

An explicit signaling could be that, for example according to the resource availability information 32 (FIG. 2*b*), the transmission of parameter length information may be signaled dynamically by the encoder by means of a bit stream element which informs a decoder about the presence/length of the parameter set length information, as already illustrated based on FIG. 3*d*.

Figure 2B:
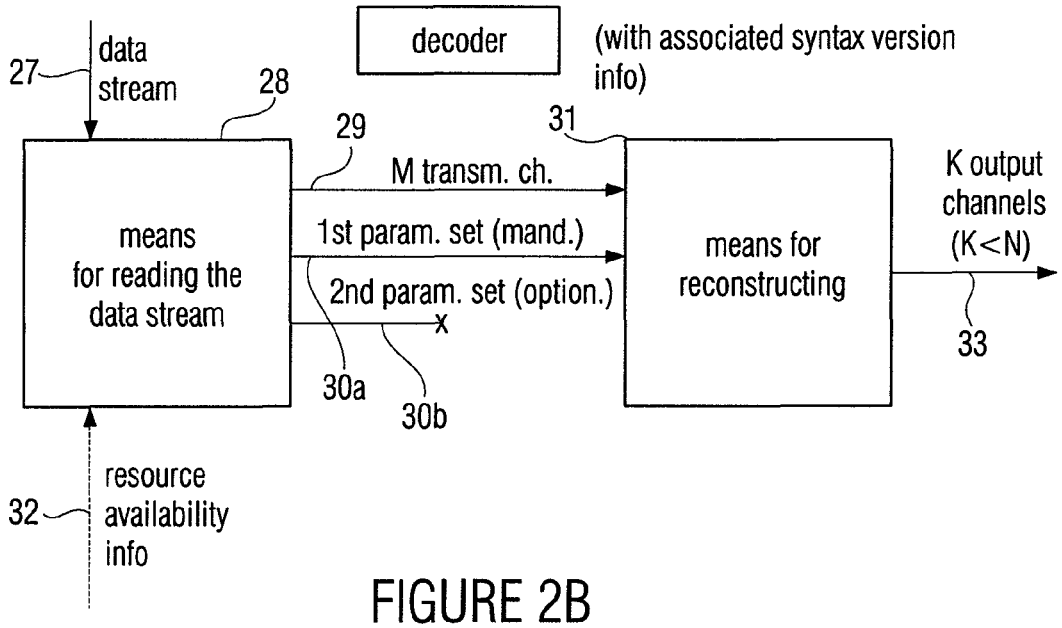
FIG. 2*b* is a block circuit diagram of a decoder according to an embodiment of the present invention.
Figure 5:
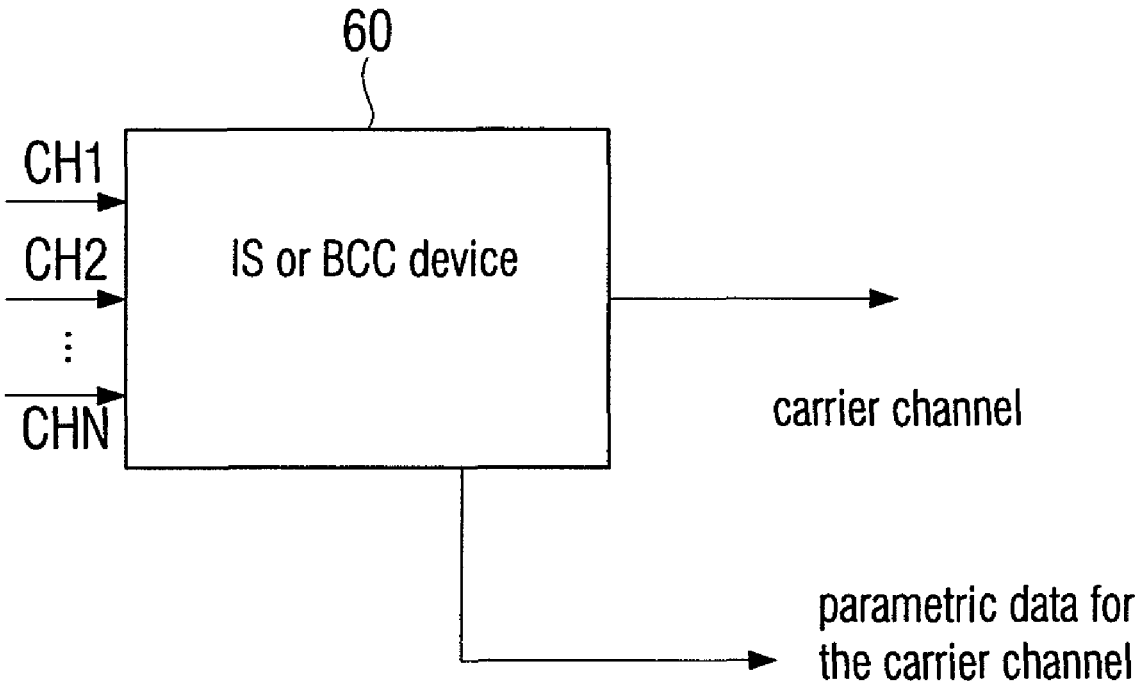
FIG. 5 shows a general representation of a multi-channel encoder.
Figure 6:
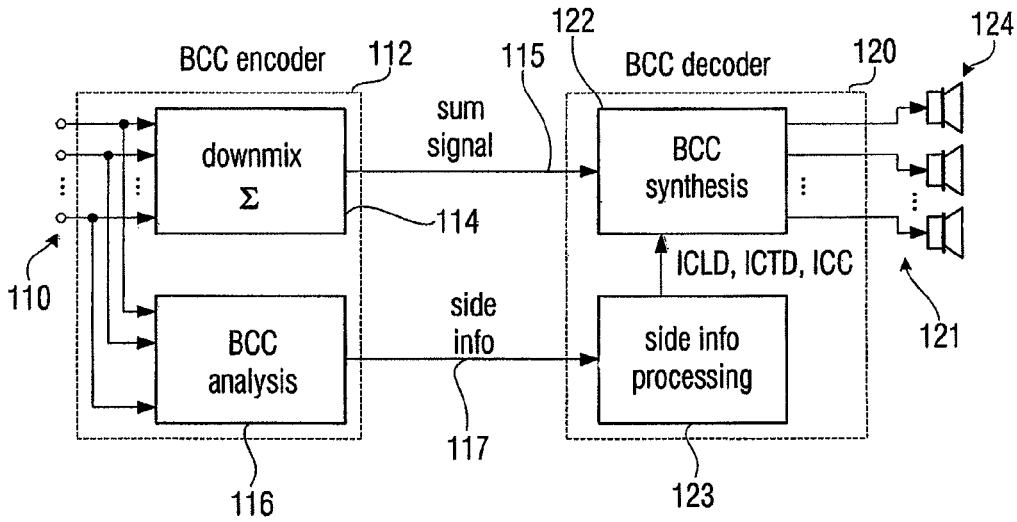
FIGURE 6 (PRIOR ART)
FIG. 6 is a schematic block diagram of a BCC encoder/BCC decoder path.

In the following, there will be discussed a preferred embodiment for a decoding process of a decoder shown in FIG. 2*b*. The preferred decoder first checks the availability of a mandatory (obligatory) parameter set that will preferably be the inter-channel level differences parameter set. When furthermore the syntax version number of the ILD parameter set is higher than the version number that the decoder itself can decode, wherein the decoder, for example, supports syntax versions from 1 to n, no reconstruction may be done by the means 31 for reconstructing of FIG. 2*b*. In all other cases, a determined form of a valid decoding process may be done by decoding the mandatory parameter set and, when no optional parameter sets are used, performing a multi-channel synthesis only using the mandatory parameter set.

However, when a decoder detects an optional parameter set, it may use it or discard its contents. Which one of the two possibilities is chosen depends, for example, on the scenario discussed below.

If the syntax version number of the optional parameter set is higher than the installed syntax version ability of the decoder itself for this parameter set type, this parameter set type cannot be processed by the decoder and will be skipped. In this case, however, there is still achieved a valid decoding without performing the improved multi-channel reconstruction using the optional parameter set type. However, if the contents of the optional parameter set may be taken into account, depending on the abilities of the decoder, there will be a reconstruction of higher quality.

For example, it is to be noted that the synthesis using inter-channel coherence values may occupy a considerable amount of computing resources. Thus, a decoder of low complexity may, for example, ignore this parameter set depending on resource control information, while a decoder that is able to provide a higher output quality will extract and use all parameter sets, i.e. both the mandatory and the optional parameter sets, for reconstruction. In a preferred embodiment, the decision of using/discarding a parameter set is made based on the availability of the computing resources at a corresponding time, i.e. dynamically.

The inventive concept provides the possibility of compatibly updating the bit stream format for non-mandatory, i.e. optional parameter set types, without interfering with the decodeability by existing decoders, i.e. the backward compatibility. Furthermore, the present invention ensures in any case that older decoders will generate an invalid output which, in the worst case, could even result in a destruction of the loudspeakers, when an update of the syntax is done by increasing the syntax version number of a mandatory parameter set, i.e. the ILD information, or optionally as illustrated, for example, by the field "BccDataId" No. 4 of FIG. 3*b*.

Figure 7:
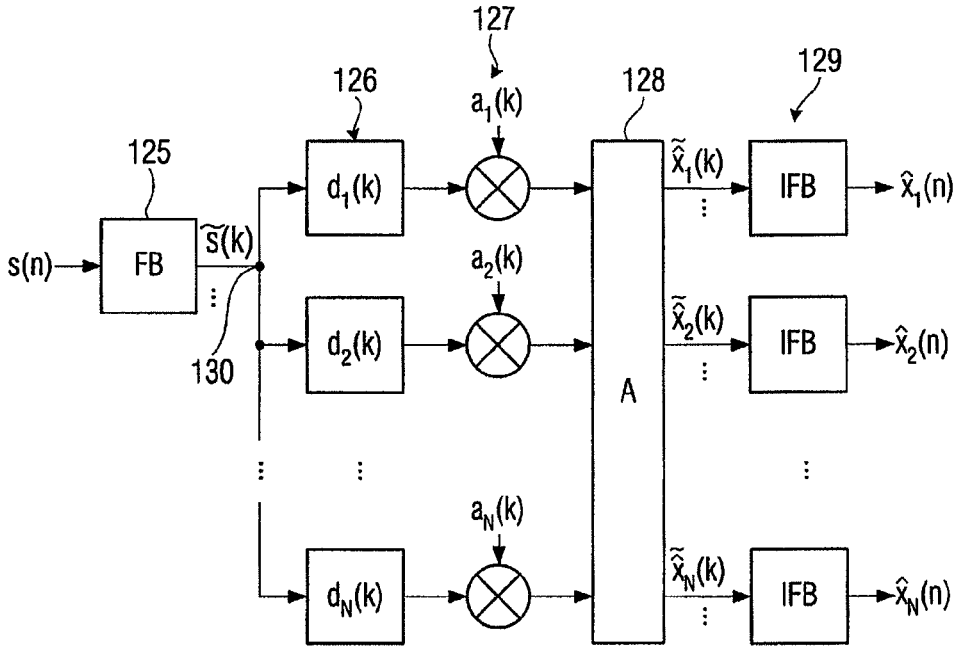
FIGURE 7 (PRIOR ART)
FIG. 7 is a block circuit diagram of the BCC synthesis block of FIG. 6.
Figure 8B:
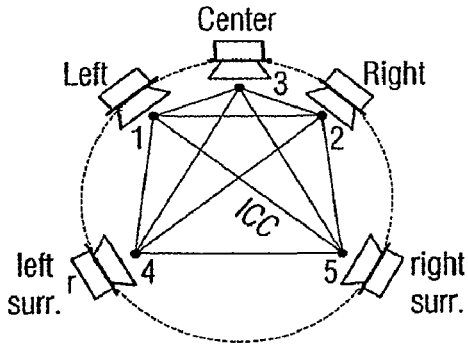
FIGURE 8B (PRIOR ART)
FIGS. 8A to 8C show a representation of typical scenarios for the calculation of the parameter sets ICLD, ICTD and ICC.
Figure 8A:
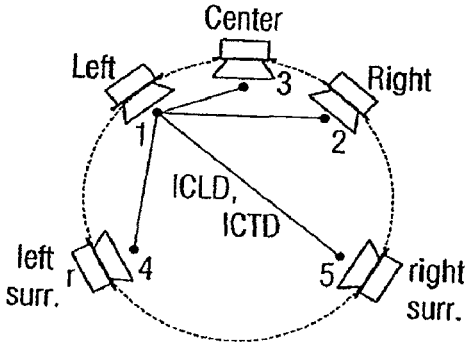
FIGURE 8A (PRIOR ART)
Figure 8C:
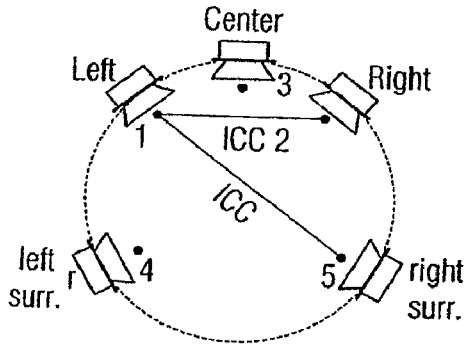
FIGURE 8C (PRIOR ART)

The inventive concept thus differs from a classic bit stream syntax in which a decoder has to know the entire syntax of each parameter set that may be used in a bit stream to be able to first read in all parameter sets in the first place to then be able to drive the corresponding processor elements, such as those illustrated in FIG. 7, with the corresponding parameters. An inventive decoder would skip the blocks 126 and 128, when only the inter-channel level differences have been extracted as mandatory parameter set, to perform a multi-channel reconstruction even if of lower quality.

In summary, there will be represented once more the essential features of the encoder in the following, which may be advantageously used by the decoder to achieve an efficient and high-quality decoding with a data stream of low data rate.

If a parameter set is less important than another parameter set in the reconstruction of the K output channels with respect to the quality of a reconstructed multi-channel signal, the means 25 for writing is designed to write the data set so that a reconstruction is possible without using the less important data set.

Preferably, the means 25 for writing is further designed to provide a parameter set with an associated identifier 100 to 105, wherein an identifier for a parameter set indicates that the parameter set absolutely has to be used for a reconstruction, or wherein an identifier for another parameter set indicates that the parameter set may only be used optionally for a reconstruction.

Preferably, the means 25 for writing is further designed to write the M transmission channels into a transmission channel portion 11 of the data set of the data stream to write a first parameter set into a first parameter set portion 12*a* and to write a second parameter set into a second parameter set portion 12*b* so that a decoder may reconstruct the K output channels without reading and interpreting the second parameter set portion (12*b*).

If the parameter sets are selected from the following group including inter-channel level differences, inter-channel time differences, inter-channel phase differences or inter-channel coherence information, the means 25 for writing is designed to mark the inter-channel level differences parameter set as mandatory for decoding and to mark at least one other parameter set of the group as optional for the decoding.

Preferably, the means 25 for writing is designed to provide the second parameter set with length information 106 to 108 indicating what amount of data in the data set belongs to the second parameter set, so that a decoder is capable of skipping the amount of data based on the length information, wherein the length information preferably comprise a first field for signaling a length in bits of a length field, and wherein the length field comprises the length in bits by which an amount of bits of the second parameter set is given.

Preferably, the means 25 for writing is further designed to write a number information 102 into the data stream indicating a number of optional parameter sets without which a reconstruction of the K output channels may be done by the decoder.

Preferably, the means 25 for writing is further designed to associate syntax version information 103 to 105 with the parameter sets, so that a decoder will perform a reconstruction using the corresponding parameter set only when syntax version information has a predetermined state.

Preferably, there is further only syntax version information for the second parameter set and further optional parameter sets, if applicable.

Furthermore, a last optional parameter set in a sequence of parameter sets in the data stream may not comprise any associated length information.

Furthermore, the means 25 for writing may be designed to signal presence and length of parameter set length information dynamically in the data stream.

The means 22 for providing may be designed to provide a sequence of data blocks for the M transmission channels that is based on a sequence of blocks of time samples of at least one original channel.

Depending on the circumstances, the inventive method for generating and/or decoding may be implemented in hardware or in software. The implementation may be done on a digital storage medium, in particular a floppy disk or CD having control signals that may be read out electronically, which may cooperate with a programmable computer system so that the method is executed. In general, the invention thus also consists in a computer program product having a program code stored on a machine-readable carrier for performing the method, when the computer program product runs on a computer. In other words, the invention may thus be realized as a computer program having a program code for performing the method, when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A device for generating a coded multi-channel audio signal representing an uncoded multi-channel audio signal comprising N original channels, wherein N is equal to or larger than 2, comprising:

a unit for providing parameter information for reconstructing K output audio signal channels from M transmission channels, wherein M is equal to or larger than 1 and less than N, wherein K is larger than M and equal to or less than N, wherein the parameter information comprises at least one first parameter set and a different second parameter set for reconstructing one and the same output channel, wherein the second parameter set comprises associated syntax version information; and a unit for writing a data stream, wherein the unit for writing is designed to write the first and the second parameter sets into the data stream so that a reconstruction of at least one of the K output channels is performable by a decoder using the first parameter set and using at least one of the M transmission channels and without using the second parameter set, wherein the unit for writing is configured to write length information indicating an amount of data of the second parameter set into the data stream, and wherein the unit for providing or the unit for writing comprises a hardware implementation.

2. The device according to claim 1, wherein a last optional parameter set in a sequence of parameter sets in the data stream does not comprise any associated length information, wherein the data stream reader is designed not to read and interpret any length information prior to reading in the last optional parameter set.

3. The device of claim 1, in which the first parameter set is a mandatory parameter set being mandatory for the reconstruction and the second parameter set is an optional parameter set being optional for the reconstruction.

4. The device of claim 1, in which the data stream writer is configured to not write any length information indicating an amount of data of the first parameter set into the data stream.

5. A decoder for decoding a coded multi-channel audio signal representing an uncoded multi-channel audio signal comprising N original channels, wherein the coded multi-channel audio signal is represented by a data stream, comprising:

a data stream reader for reading the data stream, the data stream comprising parameter information for reconstructing K output audio signal channels from M transmission channels, wherein M is equal to or larger than 1 and less than N, wherein K is larger than M and equal to or less than N, wherein the parameter information comprises at least two different parameter sets for reconstructing one and the same output channel, and wherein the first and the second parameter sets are written into the data stream so that a reconstruction of the K output channels is performable by the decoder using the first parameter set and without using the second parameter set, wherein the second parameter set comprises associated syntax version information, wherein the second parameter set comprises length information indicating an amount of data of the second parameter set, wherein the data stream reader is configured to read in the first parameter set and to skip the second parameter set when the syntax version information associated with the second parameter set is not compatible with given syntax version information of the decoder, and to read in the second parameter set when the syntax version information is compatible with the given syntax version information, wherein the data stream reader is configured to skip an amount of data in the data set indicated by the length information based on the length information without parsing the data of the second parameter set, and wherein the data stream reader comprises a hardware implementation.

6. The decoder according to claim 5, further comprising:

a reconstruction unit for reconstructing the K output channels using the M transmission channels and the first parameter set, but not using the second parameter set.

7. The decoder according to claim 6, wherein the M transmission channels are BCC downmix channels and the parameter sets include BCC parameters, and wherein the reconstruction unit is designed to perform a BCC synthesis.

8. The decoder according to claim 5, wherein the first parameter set comprises associated syntax version information, and wherein the reader is designed to read the associated syntax version information and to drive the reconstruction unit so that a reconstruction is performed by the reconstruction unit only when the read syntax version information is compatible with given syntax version information of the decoder.

9. The decoder according to claim 5, wherein the reader is controllable to obtain resource availability information, and wherein the reader is further designed to read in the second parameter set when the resource availability information indicates sufficient resources, and to skip the second parameter set when the resource availability information indicates insufficient resources.

10. The decoder according to claim 5, wherein one parameter set is less important than another parameter set in the reconstruction of the K output channels with respect to a quality of a reconstructed multi-channel audio signal, and wherein the data stream reader is designed to skip the less important data set.

11. The decoder according to claim 5, wherein the data stream comprises a parameter set with an associated identifier, wherein an identifier for a parameter set indicates that the parameter set absolutely has to be used for a reconstruction, or wherein an identifier for another parameter set indicates that the parameter set may only be used optionally for a reconstruction, wherein the data stream reader is designed to detect the identifier and to read the mandatory parameter set and to skip an optional parameter set based on the detected identifier.

12. The decoder according to claim 5, wherein the data stream comprises a first parameter set in a first parameter set portion and a second parameter set in a second parameter set portion, wherein the data stream reader is designed to interpret the data stream with respect to the parameter set portions and to read in the first parameter set portion and to skip the second parameter set portion.

13. The decoder according to claim 5, wherein parameter sets are selected from the following group including inter-channel level differences, inter-channel time differences, inter-channel phase differences or inter-channel coherence information, wherein, in the data stream, the inter-channel level differences parameter set is marked as absolutely required for decoding, and wherein at least one other parameter set of the group is marked as optional for the decoding, and wherein the data stream reader is designed to read in the inter-channel level differences parameter set and to skip another parameter set from the group.

14. The decoder according to claim 5, wherein the data stream comprises number information indicating a number of optional parameter sets without which a reconstruction of the K output channels is performable by the decoder, wherein the data stream reader is designed to read in at least one optional parameter set based on the number information.

15. The decoder according to claim 5, wherein there is associated syntax version information in the data stream for the second parameter set and further optional parameter sets, if applicable, wherein there is no syntax version information for the first parameter set.

16. The decoder according to claim 5, wherein a last optional parameter set in a sequence of parameter sets in the data stream does not comprise any associated length information, wherein the data stream reader is designed not to read and interpret any length information prior to reading in the last optional parameter set.

17. The decoder according to claim 5, wherein presence and length of parameter set length information are signaled dynamically in the data stream, and wherein the data stream reader is designed to detect first the presence of parameter set length information in the data stream to then extract the length of the parameter set length information from the data stream based on a detected presence.

18. The decoder of claim 5, in which the first parameter set is a mandatory parameter set being mandatory for the reconstruction and the second parameter set is an optional parameter set being optional for the reconstruction.

19. The decoder of claim 5, in which the data stream does not comprise any length information indicating an amount of data of the first parameter set in the data stream, and wherein the data stream reader is configured to read the first parameter set without using any length information indicating an amount of data of the first parameter set.

20. A method for generating a coded multi-channel audio signal representing an uncoded multi-channel audio signal comprising N original channels, wherein N is equal to or larger than 2, comprising:

providing, by a provider, parameter information for reconstructing K output audio signal channels from M transmission channels, wherein M is equal to or larger than 1 and less than N, wherein K is larger than M and equal to or less than N, wherein the parameter information comprises at least two different parameter sets for reconstructing one and the same output channel; and writing, by a data stream writer, a data stream by writing the first and the second parameter sets into the data stream so that a reconstruction of at least one of the K output channels is performable by a decoder using the first parameter set and using at least one of the M transmission channels without using the second parameter set, wherein the second parameter set comprises associated syntax version information, and wherein length information indicating an amount of data of the second parameter set is written into the data stream, wherein the provider or the data stream writer comprises a hardware implementation.

21. A method for decoding a coded multi-channel audio signal representing an uncoded multi-channel audio signal comprising N original channels, wherein the coded multi-channel audio signal is represented by a data stream, comprising:

reading, by a data stream reader, the data stream comprising parameter information for reconstructing K output audio signal channels from M transmission channels, wherein M is equal to or larger than 1 and less than N, wherein K is larger than M and equal to or less than N, wherein the parameter information comprises at least two different parameter sets for reconstructing one and the same output channel, and wherein the first and the second parameter sets are written into the data stream so that a reconstruction of the K output channels is performable by a decoder using the first parameter set and without using the second parameter set, wherein the second parameter set comprises associated syntax version information, wherein the second parameter set comprises length information indicating an amount of data of the second parameter set, wherein the first parameter set is read and the second parameter set is skipped, when the syntax version information associated with the second parameter set is not compatible with given syntax version information of the decoder, or wherein the second parameter set is read, when the syntax version information is compatible with the given syntax version information, wherein an amount of data in the data stream indicated by the length information is skipped based on the length information without parsing the data of the second parameter set, and wherein the data stream reader comprises a hardware implementation.

22. Non-transitory computer-readable storage medium having stored thereon a computer program having a program code for performing the method for generating a coded multi-channel audio signal representing an uncoded multi-channel audio signal comprising N original channels, wherein N is equal to or larger than 2, when the computer program runs on a computer, the method comprising providing parameter information for reconstructing K output audio signal channels from M transmission channels, wherein M is equal to or larger than 1 and less than N, wherein K is larger than M and equal to or less than N, wherein the parameter information comprises at least two different parameter sets for reconstructing one and the same output channel; and writing a data stream by writing the first and the second parameter sets into the data stream so that a reconstruction of at least one of the K output channels is performable by a decoder using the first parameter set, and using at least one of the M transmission channels, wherein the second parameter set is not used in the reconstruction, wherein the second parameter set comprises associated syntax version information, and wherein length information indicating an amount of data of the second parameter set is written into the data stream.

23. Non-transitory computer-readable storage medium having stored thereon a computer program having a program code for performing the method for decoding a coded multi-channel audio signal representing an uncoded multi-channel audio signal comprising N original channels, wherein the coded multi-channel audio signal is represented by a data stream, when the computer program runs on a computer, the method comprising reading the data stream comprising parameter information for reconstructing K output audio signal channels from M transmission channels, wherein M is equal to or larger than 1 and less than N, wherein K is larger than M and equal to or less than N, wherein the parameter information comprises at least two different parameter sets for reconstructing one and the same output channel, and wherein the first and the second parameter sets are written into the data stream so that a reconstruction of the K output channels is performable by a decoder using the first parameter set and without using the second parameter set, wherein the second parameter set comprises associated syntax version information, wherein the second parameter set comprises length information indicating an amount of data of the second parameter set, wherein the first parameter set is read and the second parameter set is skipped, when the syntax version information associated with the second parameter set is not compatible with given syntax version information of the decoder, or wherein the second parameter set is read, when the syntax version information is compatible with the given syntax version information, and wherein an amount of data in the data stream indicated by the length information is skipped based on the length information without parsing the data of the second parameter set.

* * * * *